US007647878B1

(12) United States Patent
Santiago

(10) Patent No.: US 7,647,878 B1
(45) Date of Patent: Jan. 19, 2010

(54) MANUALLY OPERATED SHALLOW WATER ANCHOR

(75) Inventor: Carlos Santiago, Winter Park, FL (US)

(73) Assignee: Reel Shallow Anchor, Inc., Winter Park, FL (US)

( * ) Notice: Subject to any disclaimer, the term of this patent is extended or adjusted under 35 U.S.C. 154(b) by 0 days.

(21) Appl. No.: 12/174,724

(22) Filed: Jul. 17, 2008

(51) Int. Cl.
*B63B 21/24* (2006.01)

(52) U.S. Cl. ..... 114/294; 114/230.13

(58) Field of Classification Search ..... 114/230.1, 114/230.13, 230.15, 230.16, 294, 295, 301; 405/1, 7

See application file for complete search history.

(56) References Cited

U.S. PATENT DOCUMENTS 3,571,836 A * 3/1971 Dunlap ..... 114/230.1
4,254,730 A * 3/1981 Crenshaw ..... 114/294
6,041,730 A * 3/2000 Oliverio et al. ..... 114/294
6,220,197 B1 * 4/2001 Pohlman ..... 114/294
6,273,016 B1 * 8/2001 Gibbs ..... 114/230.1
7,270,072 B2 * 9/2007 Waldrop ..... 114/295

* cited by examiner

*Primary Examiner*—Lars A Olson
(74) *Attorney, Agent, or Firm*—Mark Terry

(57) ABSTRACT

An apparatus for anchoring a boat to a bottom of a body of water is disclosed. The apparatus includes a base securely coupled to a transom of a boat and an elongated member having a proximal end hingably coupled to the base. The apparatus further includes a spear hingably coupled to a distal end of the elongated member, such that when the elongated member is positioned substantially horizontally, the spear is positioned substantially vertically so as to extend below a hull of the boat. The apparatus further includes a maneuvering arm hingably coupled to the elongated member for manually lowering the elongated member into a substantially horizontal position. The apparatus further includes a stopping member perpendicularly coupled to the distal end of the elongated member, so as to halt the spear from rotating beyond ninety degrees from the elongated member.

18 Claims, 5 Drawing Sheets

MANUALLY OPERATED SHALLOW WATER ANCHOR

BACKGROUND OF THE INVENTION

1. Field of the Invention

This invention relates to shallow water anchors and more particularly to manually operated shallow water anchors.

2. Description of the Related Art

Typical marine anchors for small boats comprise a heavy metal anchor with an irregular shape, which is attached to the boat via a long chain or rope. The anchor and chain/rope are usually stored on the deck of the boat or in a compartment on the deck. When use of the anchor is necessary, it is picked up and thrown into the water. The anchor subsequently rests on the floor or bottom of the body of water and secures the boat to a fixed location due to the weight of the anchor. Typical marine anchors, however, come with their share of drawbacks.

Because typical marine anchors have a long rope or chain attaching them to a boat, they can often become tangled or snagged on various items. This requires the user to untangle or un-snag the rope or chain before it can be deployed—a tedious and time-consuming process. Further, the heavy weight of the anchor requires the user to carefully pick up the anchor and throw it overboard so as to avoid hitting the fragile deck or hull of the boat and cause damage—a feat that requires strength, balance and agility. The user encounters a similar situation when retracting the anchor from the ocean or lake bottom. Additionally, when deploying or retracting the anchor, the unwieldy nature of the marine anchor often causes substantial noise that is distracting and can scare off fish, which is not desirable for a fisherman. Lastly, the heavy nature of the anchor can cause damage to the ocean or lake bottom since the anchor can be dragged or may move around. This is not desirable in areas where fragile ocean life resides, such as reefs and underwater vegetation areas.

Fishing in shallow or littoral waters brings up an additional set of requirements for an anchor. In shallow water, for example, fish are confined to a smaller area, thereby requiring that the fisherman be extra quiet when propelling and deploying/retracting an anchor. Further, during shallow water fishing, a fisherman typically moves around frequently as he attempts fishing in different spots. This requires frequent deployment and retraction of an anchor. As such, an anchor that requires substantial time and energy to deploy and retract can be burdensome to a fisherman in a shallow water environment.

One approach to this problem is a mechanized marine anchor system that automates the process of deploying and retracting an anchor. Mechanized marine anchor systems typically utilize electrical power to energize an electrical motor having a mechanical means for deploying and retracting an anchor. Although this type of system eliminates the need for manual operation, a mechanized marine anchor system requires an electrical system that is operational during deployment and retraction of an anchor. This is not always easily available in a small boat such as a flats boat. Furthermore, a motor may cause excessive noise, which is not desirable in a shallow water environment, as described above. Lastly, a mechanized marine anchor system comprises a complicated system with multiple moving parts and electrical terminals, which are prone to malfunctioning, especially in a saltwater environment.

Therefore, a need exists to overcome the problems with the prior art as discussed above, and particularly for a more efficient way for deploying and retracting an anchor in shallow water.

BRIEF SUMMARY OF THE INVENTION

Embodiments of the present invention address deficiencies of the art with respect to marine anchors and provide a novel apparatus for facilitating frequent manual deployment and retraction of a quiet shallow water anchor. In an embodiment of the invention, an apparatus for anchoring a boat to a bottom of a body of water is disclosed. The apparatus includes a base securely coupled to a transom of a boat and an elongated member having a proximal end hingably coupled to the base. The apparatus further includes a spear hingably coupled to a distal end of the elongated member, such that when the elongated member is positioned substantially horizontally, the spear is positioned substantially vertically so as to extend below a hull of the boat. The apparatus further includes a maneuvering arm hingably coupled to the elongated member for manually lowering the elongated member into a substantially horizontal position. The apparatus further includes a stopping member perpendicularly coupled to the distal end of the elongated member, so as to halt the spear from rotating beyond ninety degrees from the elongated member.

In another embodiment of the invention, an apparatus for anchoring a boat to a bottom of a body of water is disclosed. The apparatus includes a base securely coupled to a boat and an elongated member having a proximal end hingably coupled to the base and a gutter extending the length of the elongated member. The apparatus further includes a spear hingably coupled to a distal end of the elongated member, such that when the elongated member is positioned substantially horizontally, the spear is positioned substantially vertically so as to extend below a hull of the boat, and wherein the when the elongated member is positioned substantially vertically, the spear is positioned substantially vertically within the gutter. The apparatus further includes a maneuvering arm hingably coupled to the elongated member for manually lowering the elongated member into a substantially horizontal position. The apparatus further includes a stopping member perpendicularly coupled to the distal end of the elongated member, so as to halt the spear from rotating beyond ninety degrees from the elongated member.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown.

DETAILED DESCRIPTION OF THE INVENTION

Embodiments of the present invention address deficiencies of the art with respect to marine anchors and provide a novel apparatus for facilitating frequent manual deployment and retraction of a quiet shallow water anchor. In one embodiment of the invention, an apparatus for anchoring a boat to a bottom of a body of water is disclosed. The apparatus includes a base securely coupled to a transom of a boat and an elongated member having a proximal end hingably coupled to the base. The apparatus further includes a spear hingably coupled to a distal end of the elongated member, such that when the elongated member is positioned substantially horizontally, the spear is positioned substantially vertically so as to extend below a hull of the boat. The apparatus further includes a maneuvering arm hingably coupled to the elongated member for manually lowering the elongated member into a substantially horizontal position. The apparatus further includes a stopping member perpendicularly coupled to the distal end of the elongated member, so as to halt the spear from rotating beyond ninety degrees from the elongated member.

The present invention is advantageous as it allows for the manual deployment and retraction of a lightweight and durable shallow water anchor that does not require electricity or fuel. The shallow water anchor of the present invention is fully manual and therefore only requires the strength of an individual. Further, the shallow water anchor of the present invention comprises a minimum number of parts that reduces or eliminates the possibility of malfunction and minimizes wear and tear. Also, the shallow water anchor of the present invention can be deployed and retracted quickly and easily using a minimal amount of human power, therefore allowing for the frequent deployment and retraction of the anchor during shallow water fishing. Additionally, operation of the shallow water anchor of the present invention produces little to no noise, thereby reducing or eliminating the possibility of scaring away fish while engaged in the sport of fishing. Also, the lightweight nature of the shallow water anchor, in addition to its small footprint, causes little affect on the ocean or lake bottom, thereby reducing the possibility of causing damage to fragile underwater ecosystems. Lastly, the shallow water anchor of the present invention is constructed from a durable and lightweight material that facilitates ease of use and increases its life cycle in a salt water environment.

Figure 1:
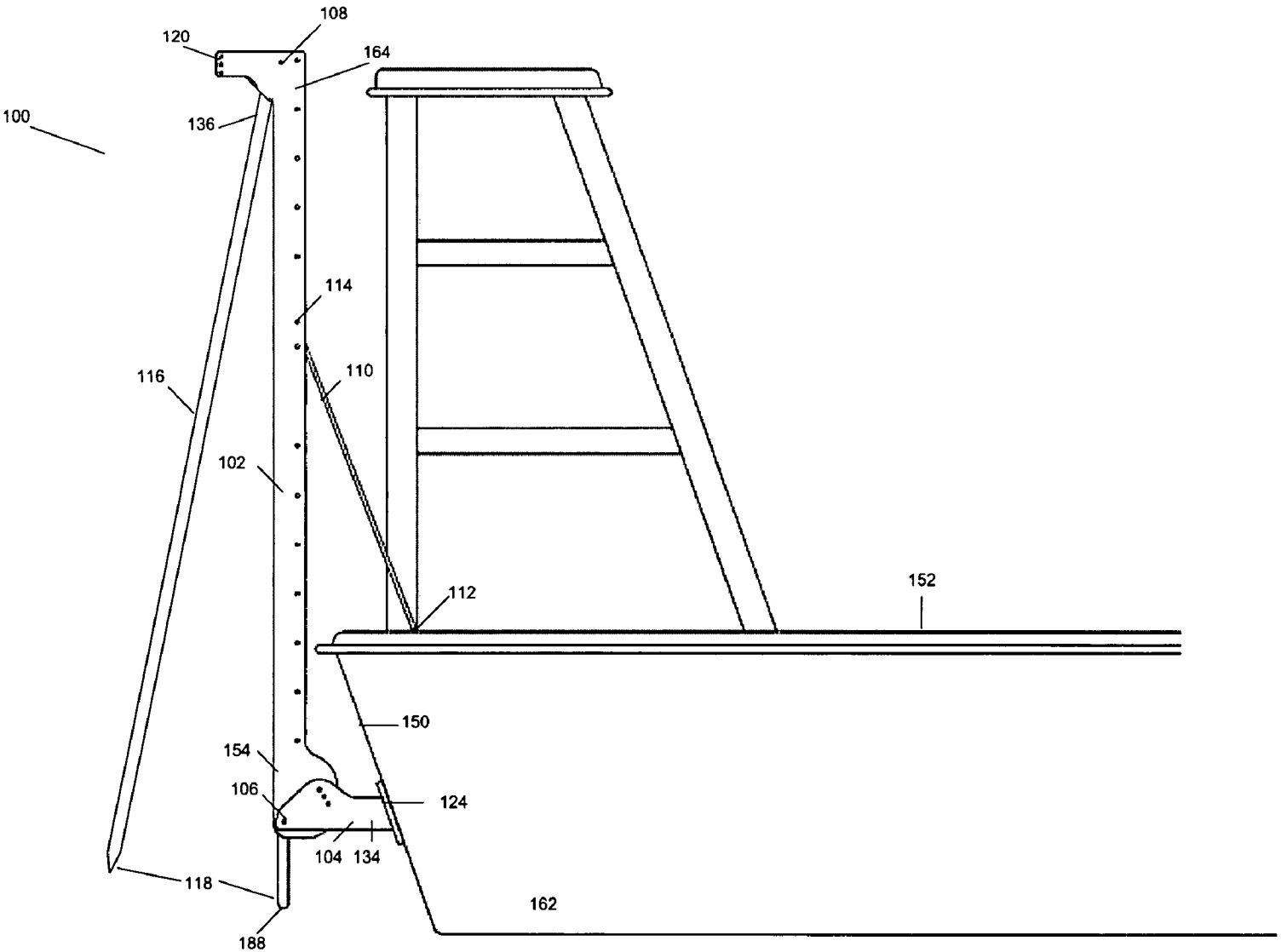
FIG. 1 is an illustration of a side view of the shallow water anchor 100 according to one embodiment of the present invention.
Figure 2:
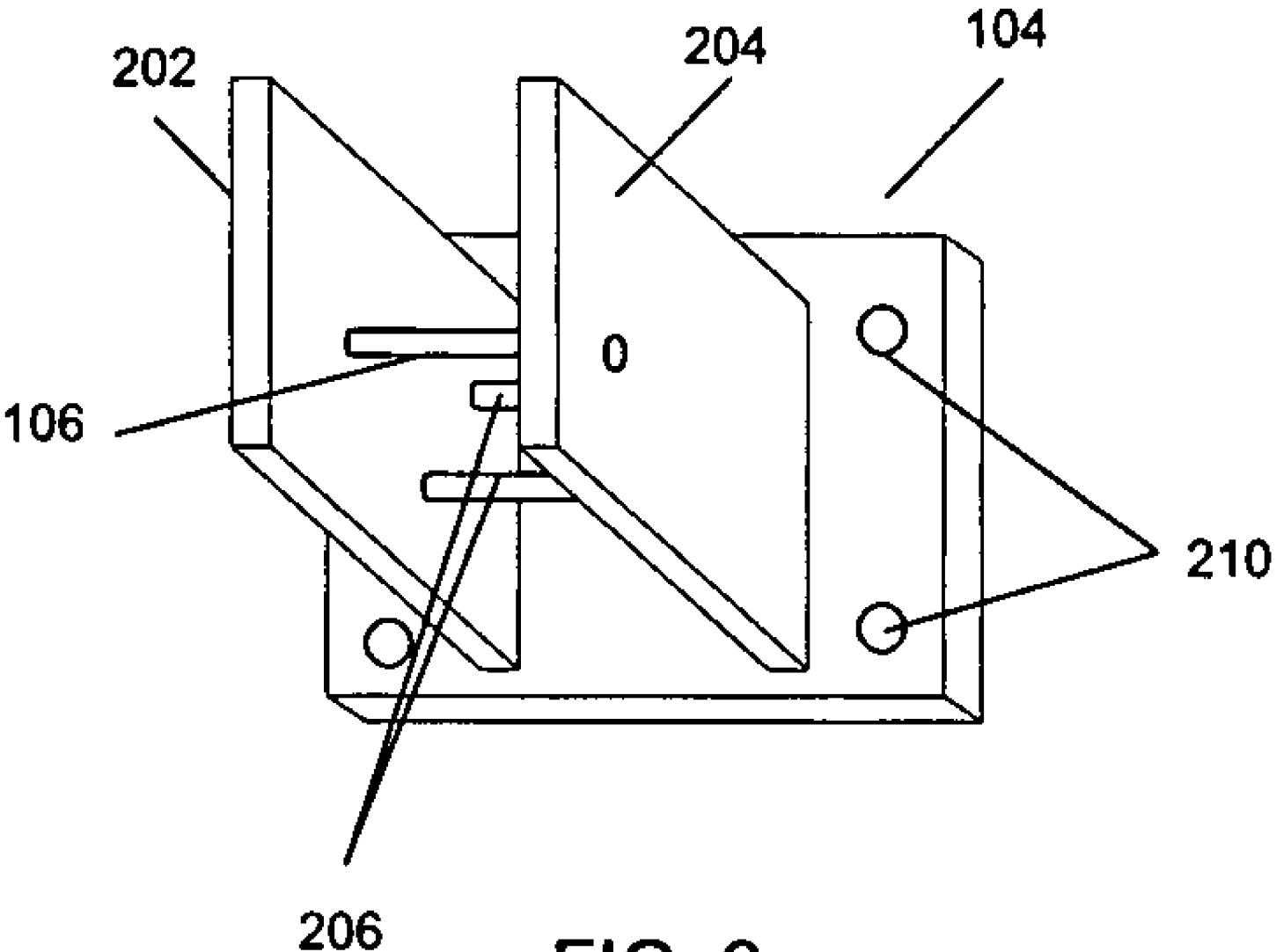
FIG. 2 is an illustration of a perspective view of the base FIG. 1, according to one embodiment of the present invention.

FIG. 1 is an illustration of a side view of the shallow water anchor 100 according to one embodiment of the present invention. The shallow water anchor 100 includes a base 104 securely coupled to a transom 150 of a boat 152. The base 104 may also be secured to other portions of the boat 152. The base 104 includes a planar portion 124 having orifices 210 through which fasteners (such as screws or bolts) are threaded and coupled to the transom 150, as shown in FIG. 2. The base 104 also includes a protruding portion 134 extending perpendicularly from the planar portion 124, the protruding portion 134 including a hinge 106 to which the proximal end 154 of the elongated member 102 is coupled. The hinge 106 may be a butt hinge about which the elongated member 102 rotates.

Figure 3:
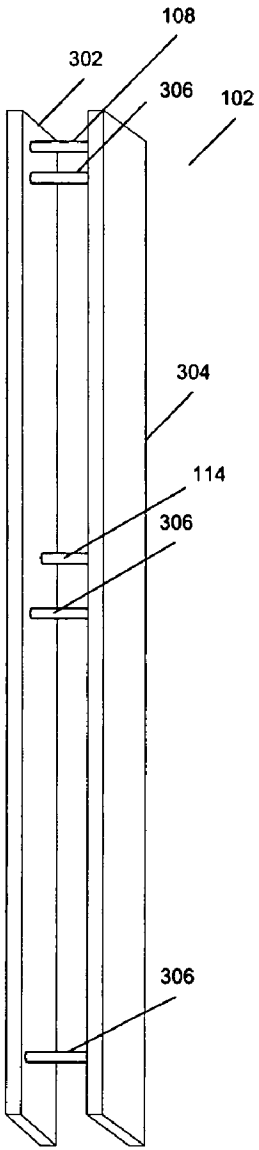
FIG. 3 is an illustration of a perspective view of the elongated member of FIG. 1, according to one embodiment of the present invention.

In one embodiment of the present invention, the protruding portion 134 may comprise a first planar member 202 and a second planar member 204, wherein the second planar member 204 is coupled in parallel to the first planar member 204 via one or more bolts or connectors 206, as shown in FIG. 2. In this embodiment, the hinge 106 includes a cylinder that spans the gap or gutter between first planar member 202 and a second planar member 204. Also in this embodiment, the elongated member 102 fits between first planar member 202 and a second planar member 204. Similarly, the elongated member 102 may comprise a first elongated planar member 302 and a second elongated planar member 304, wherein the second elongated planar member 304 is coupled in parallel to the first elongated planar member 302 via one or more bolts or connectors 306, as shown in FIG. 3. A gap or gutter exists between second elongated planar member 304 and first elongated planar member 302.

The shallow water anchor 100 also includes a spear 116 hingably coupled to a distal end 164 of the elongated member 102. The spear 116 is an elongated rod having a sharpened distal end 118 and a proximal end 136 coupled to a hinge 108 on the distal end 164 of the elongated member 102. The hinge 108 may be a butt hinge about which the spear 116 rotates. In this embodiment, the hinge 108 includes a cylinder that spans the gap or gutter between first elongated planar member 302 and second elongated planar member 304, as shown in FIG. 3. Also in this embodiment, the spear 116 fits between first elongated planar member 302 and second elongated planar member 304.

FIG. 1 shows spear 116 positioned at a slight angle to the elongated member 102 for illustrative purposes only. As explained above, when the elongated member 102 and the spear 116 are positioned substantially vertically, the spear 116 is positioned between the first elongated planar member 302 and the second elongated planar member 304. Item 188 shows spear 116 positioned substantially vertically such that the spear 116 is positioned between the first elongated planar member 302 and the second elongated planar member 304.

Also, spear 116 may have a length greater than the length of the elongated member 102, such that when the elongated member 102 and the spear 116 are positioned substantially vertically, the distal end 118 of the spear 116 extends below the proximal end 154 of the elongated member 102. Item 188 shows spear 116 positioned substantially vertically such that the distal end 118 of the spear 116 extends below the proximal end 154 of the elongated member 102.

When the elongated member 102 is positioned substantially horizontally, the spear 116 is positioned substantially vertically so as to extend below the hull 162 of the boat 152. This is shown in greater detail below with reference to FIGS. 4 and 5 below.

The shallow water anchor 100 also includes a maneuvering arm 110 hingably coupled to the elongated member 102 for manually lowering the elongated member 102 into a substantially horizontal position. The maneuvering arm 110 comprises an elongated rod having a distal end coupled to a hinge 114 on substantially a midsection of the elongated member 102 and a proximal end including a handle 112. The hinge 114 may be a butt hinge about which the maneuvering arm 110 rotates. Note that the hinge 114 is positioned on a side of the elongated member 102 opposite the side to which the spear 116 is positioned.

FIG. 1 shows maneuvering arm 110 positioned at a slight angle to the elongated member 102 for illustrative purposes only. When the elongated member 102 and the maneuvering arm 110 are positioned substantially vertically, the maneuvering arm 110 can be positioned between the first elongated planar member 302 and the second elongated planar member 304.

The shallow water anchor 100 also includes a stopping member 120 perpendicularly coupled to the distal end 164 of the elongated member 102. The stopping member 120 halts the spear 116 from rotating beyond ninety degrees from the elongated member 102.

Figure 4:
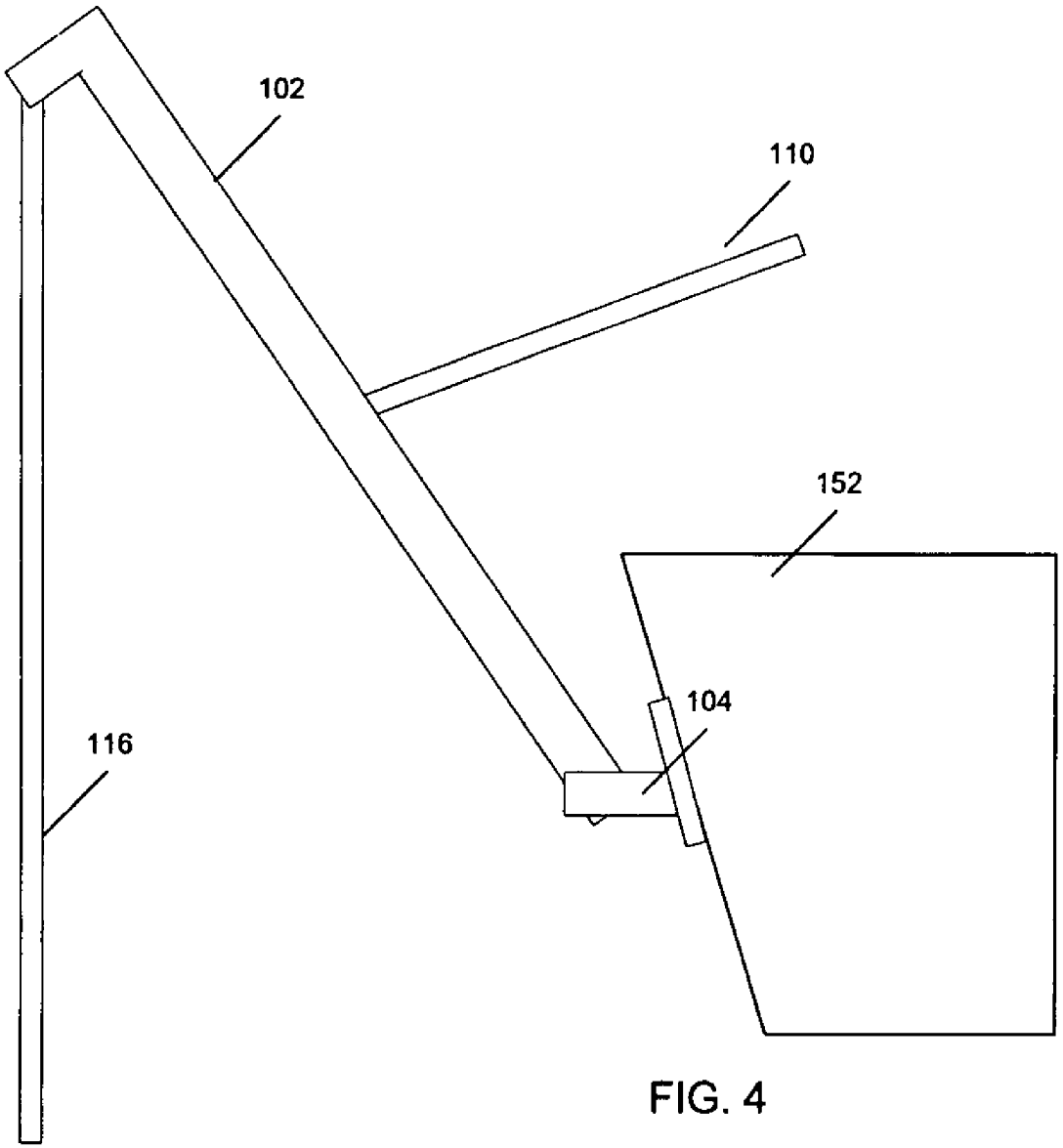
FIG. 4 is an illustration of the shallow water anchor of FIG. 1 during the process of deployment.

FIG. 4 is an illustration of the shallow water anchor 100 of FIG. 1 during the process of deployment. FIG. 4 shows that the maneuvering arm 110 has been handled or lifted by a person so as to rotate about hinge 114 in the elongated member 102. The stiff maneuvering arm 110 is then used to push elongated arm 102 towards the body of water in which boat 152 is floating such that the elongated member rotates about hinge 106 in the base 104. FIG. 4 shows the elongated member 102 in the middle of the deployment process, at about a forty-five degree angle from the vertical.

As the elongated arm 102 is pushed or falls towards the body of water in which boat 152 is floating such that the elongated member rotates about hinge 106 in the base 104, the spear 116 rotates about the hinge 108 in the elongated member 102 so as to maintain a substantially vertical position.

Figure 5:
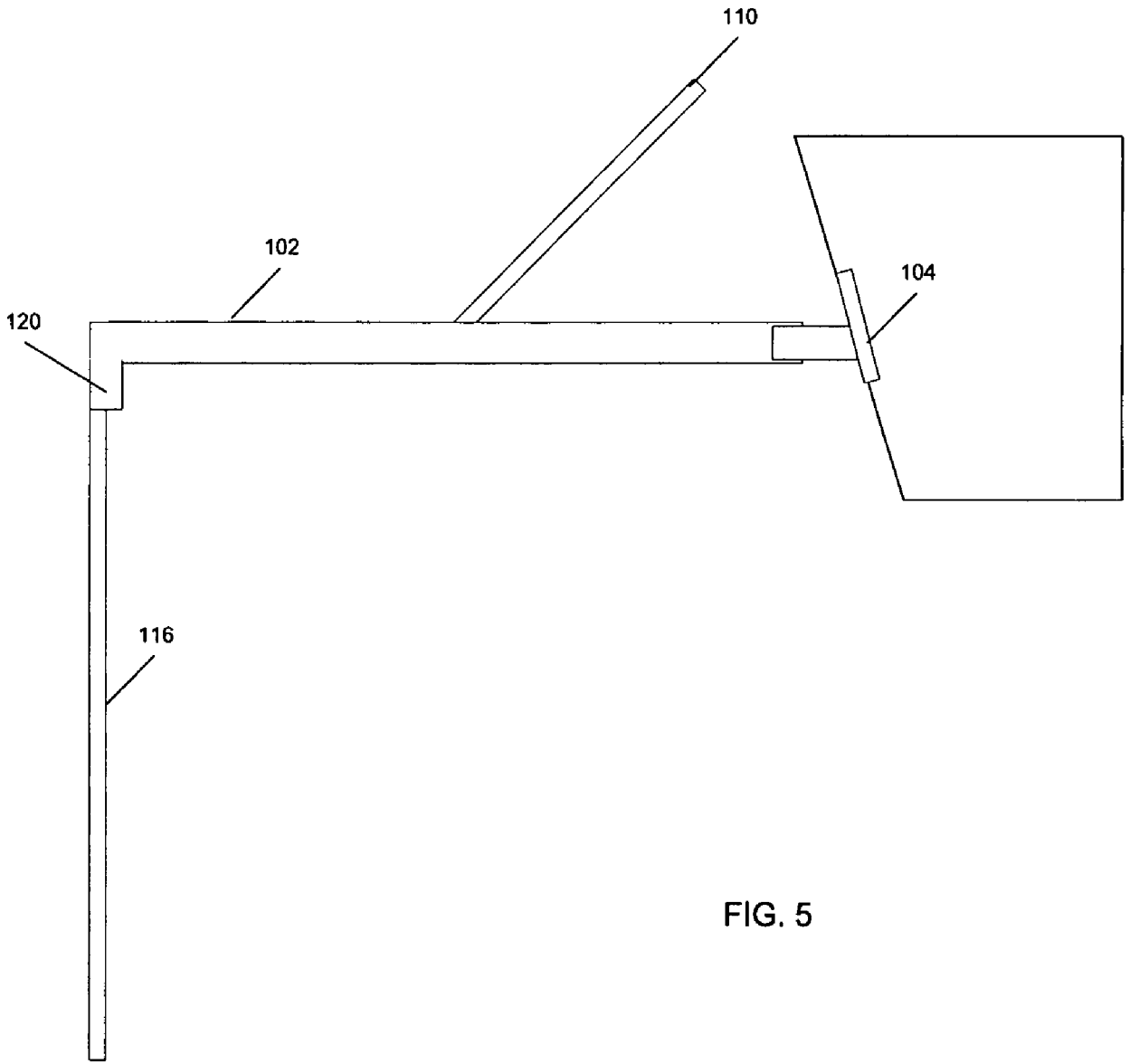
FIG. 5 is an illustration of the shallow water anchor of FIG. 1 in full deployment.

FIG. 5 is an illustration of the shallow water anchor 100 of FIG. 1 in full deployment. FIG. 5 shows that the maneuvering arm 110 has been used to maneuver elongated arm 102 towards the body of water in which boat 152 is floating such that the elongated member rotates about hinge 106 in the base 104. FIG. 5 shows the elongated member 102 in full deployment, substantially parallel to the ground, or simply horizontal.

As the elongated arm 102 is pushed or falls towards the body of water in which boat 152 is floating such that the elongated member rotates about hinge 106 in the base 104, the spear 116 rotates about the hinge 108 in the elongated member 102 so as to maintain a substantially vertical position. FIG. 5 shows that the spear 116 has been fully extended into the body of water such that the tip 118 of the spear 116 drives into the bottom of the body of water, thereby anchoring the boat 152 securely in place. Note that stopping element 120 halts the spear 116 from rotating beyond ninety degrees from the elongated member 102.

The components of the shallow water anchor 100 can be manufactured from a variety of materials using a variety of methods. In one embodiment of the present invention, the components of the shallow water anchor 100 can be manufactured from hot-forged alloy steel that is oil quenched and tempered for maximum strength and durability. Additionally, the components of the shallow water anchor 100 may include nickel-chrome plating that resists rust.

The components of the shallow water anchor 100 can further be manufactured using a variety of methods for casting metals, such as sand casting, die casting, permanent mold casting, investment casting, centrifugal casting, and lost foam casting. The components of the shallow water anchor 100 can further be manufactured using metal injection molding (MIM) method for preparing metals.

The components of the shallow water anchor 100 can further be manufactured using a variety of metals, such as ferrous metals and alloys. Ferrous metals and alloys are iron-based materials that are used in a wide variety of industrial applications. Examples include carbon steels, alloy steels, stainless steels, tool steels, cast iron, cast steel, maraging steel, and specialty or proprietary iron-based alloys. The components of the shallow water anchor 100 can further be manufactured using nickel and nickel alloys.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

I claim:

1. An apparatus for anchoring a boat to a bottom of a body of water, comprising:

a base securely coupled to a transom of a boat;

an elongated member having a proximal end hingably coupled to the base;

a spear hingably coupled to a distal end of the elongated member, such that when the elongated member is positioned substantially horizontally, the spear is positioned substantially vertically so as to extend below a hull of the boat;

a maneuvering arm hingably coupled to the elongated member for manually lowering the elongated member into a substantially horizontal position; and a stopping member perpendicularly coupled to the distal end of the elongated member, so as to halt the spear from rotating beyond ninety degrees from the elongated member.

2. The apparatus of claim 1, wherein the base comprises:

a planar portion having orifices through which fasteners are threaded and coupled to the transom; and a protruding portion extending perpendicularly from the planar portion, the protruding portion including a hinge to which the proximal end of the elongated member is coupled.

3. The apparatus of claim 2, wherein the hinge comprises a butt hinge.

4. The apparatus of claim 3, wherein the elongated member comprises:

a first elongated planar member; and a second elongated planar member, wherein the second elongated planar member is coupled in parallel to the first elongated member.

5. The apparatus of claim 4, wherein the elongated member further comprises:

a butt hinge positioned at its distal end, to which the spear is coupled.

6. The apparatus of claim 5, wherein the spear comprises:

an elongated rod having a sharpened distal end and a proximal end coupled to the butt hinge of the elongated member.

7. The apparatus of claim 6, wherein the spear has a length greater than the length of the elongated member, such that when the elongated member and the spear are positioned substantially vertically, the distal end of the spear extends below the proximal end of the elongated member.

8. The apparatus of claim 7, wherein when the elongated member and the spear are positioned substantially vertically, the spear is positioned between the first elongated planar member and the second elongated planar member.

9. The apparatus of claim 8, wherein when the maneuvering arm comprises:

an elongated rod comprising:

a distal end coupled to a hinge on substantially a mid-section of the elongated member; and a proximal end including a handle.

10. The apparatus of claim 9, wherein when the hinge on substantially a midsection of the elongated member comprises:

a butt hinge positioned on a first side of the elongated member, wherein the first side is opposite a side of the elongated member to which the spear is coupled.

11. An apparatus for anchoring a boat to a bottom of a body of water, comprising:

a base securely coupled to a boat;

an elongated member having a proximal end hingably coupled to the base and a gutter extending the length of the elongated member;

a spear hingably coupled to a distal end of the elongated member, such that when the elongated member is positioned substantially horizontally, the spear is positioned substantially vertically so as to extend below a hull of the boat, and wherein the when the elongated member is positioned substantially vertically, the spear is positioned substantially vertically within the gutter;

a maneuvering arm hingably coupled to the elongated member for manually lowering the elongated member into a substantially horizontal position; and a stopping member perpendicularly coupled to the distal end of the elongated member, so as to halt the spear from rotating beyond ninety degrees from the elongated member.

12. The apparatus of claim 11, wherein the base comprises:

a planar portion having orifices through which fasteners are threaded and coupled to the boat; and a protruding portion extending perpendicularly from the planar portion, the protruding portion including a hinge to which the proximal end of the elongated member is coupled.

13. The apparatus of claim 12, wherein the hinge comprises a butt hinge.

14. The apparatus of claim 13, wherein the elongated member comprises:

a first elongated planar member; and a second elongated planar member, wherein the second elongated planar member is coupled in parallel to the first elongated member.

15. The apparatus of claim 14, wherein the elongated member further comprises:

a butt hinge positioned at its distal end, to which the spear is coupled.

16. The apparatus of claim 15, wherein the spear comprises:

an elongated rod having a sharpened distal end and a proximal end coupled to the butt hinge of the elongated member.

17. The apparatus of claim 16, wherein the spear has a length greater than the length of the elongated member, such that when the elongated member and the spear are positioned substantially vertically, the distal end of the spear extends below the proximal end of the elongated member.

18. The apparatus of claim 17, wherein when the maneuvering arm comprises:

an elongated rod comprising:

a distal end coupled to a hinge on substantially a midsection of the elongated member; and a proximal end including a handle.

* * * * *